US005309721A

United States Patent [19]

Rathbone

[11] Patent Number: 5,309,721

[45] Date of Patent: May 10, 1994

[54] AIR SEPARATION

[75] Inventor: Thomas Rathbone, Farnham, England

[73] Assignee: The BOC Group plc, Windlesham, England

[21] Appl. No.: 43,426

[22] Filed: Apr. 6, 1993

[30] Foreign Application Priority Data

Apr. 22, 1992 [GB] United Kingdom ..... 9208645

[51] Int. Cl.[5] ..... F25J 3/02

[52] U.S. Cl. ..... 62/39; 62/24

[58] Field of Search ..... 62/24, 39

[56] References Cited

U.S. PATENT DOCUMENTS

| | | | |
|---|---|---|---|
| 3,736,762 | 6/1973 | Toyama et al. | 62/39 |
| 4,072,023 | 2/1978 | Springmann | 62/39 |
| 5,036,672 | 8/1991 | Rottmann | 62/39 |
| 5,123,946 | 6/1992 | Ha | 62/39 |
| 5,165,244 | 11/1992 | Kleinberg et al. | 62/39 |

*Primary Examiner*—Ronald C. Capossela

*Attorney, Agent, or Firm*—David M. Rosenblum; Larry R. Cassett

[57] ABSTRACT

An improvement to a gaseous oxygen cycle in which refrigeration is provided by two expansion turbines each fed with nitrogen. In addition, some nitrogen is recompressed, returned though the main heat exchanger, condensed and used to form a liquid nitrogen product.

12 Claims, 1 Drawing Sheet

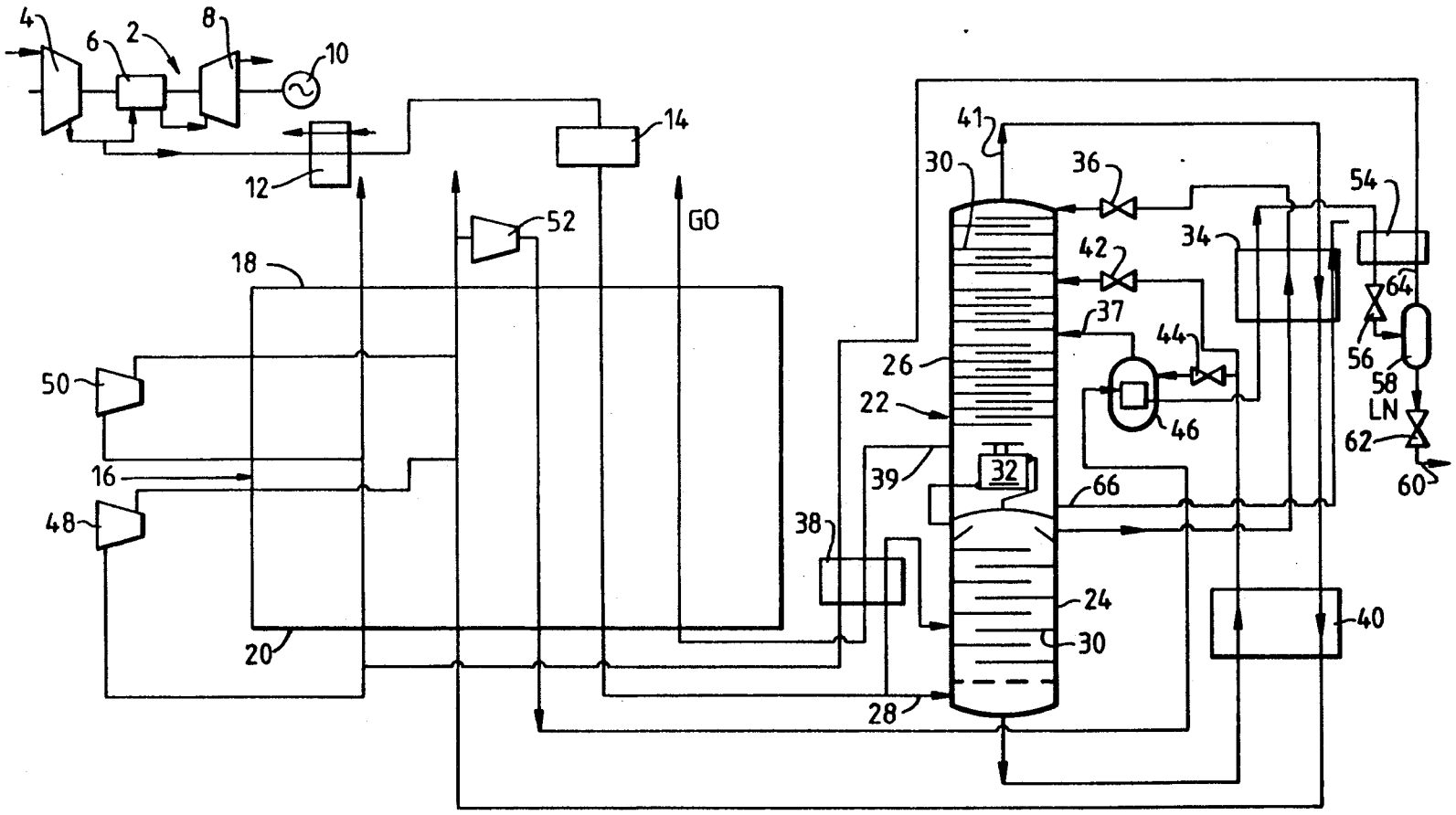
LN
GO

AIR SEPARATION

BACKGROUND OF THE INVENTION

This invention relates to a method and apparatus for separating air.

In a modern air separation plant, a stream of air is compressed and has components of low volatility such as water vapour and carbon dioxide removed therefrom. The resultant purified air stream is cooled by heat exchange with returning streams to a cryogenic temperature suitable for its separation by rectification. The rectification is performed in a so-called "double rectification column" comprising a higher pressure and a lower pressure rectification column. Most if not all of the air is introduced into the higher pressure column and is separated into oxygen-enriched liquid air and nitrogen vapour. The nitrogen vapour is condensed in a condenser-reboiler which links the higher pressure column with the lower pressure column, the condensation being performed by heat exchange with liquid oxygen collecting in the bottom of the lower pressure column, the liquid oxygen thereby being reboiled. A part of the resulting liquid nitrogen condensate is used as reflux in the higher pressure column, and the remainder is withdrawn from the higher pressure column, is sub-cooled, and is passed through a pressure reduction of throttling valve into the top of the lower pressure column and provides the reflux for that column. Oxygen-enriched liquid is withdrawn from the bottom of the higher pressure column is sub-cooled and is introduced into an intermediate region of the lower pressure column through a throttling or pressure reduction valve. The oxygen-enriched liquid is separated into oxygen and nitrogen products in the lower pressure column. These products are withdrawn in the vapour state from the lower pressure column and form the returning streams against which the incoming air stream is heat exchanged.

Such an air separation process is performed at cryogenic temperatures. Notwithstanding the thermal insulation of these parts of the air separation plant operating at below ambient temperature, there is a need for refrigeration to be generated to compensate for heat "inleak" into the plant. This need is normally met by expanding a minor stream of the purified air in a turbine with the performance of external work. This work may be to drive a booster-compressor which feeds the expansion turbine with purified air for expansion at a pressure in excess of that at which the higher pressure column receives the main flow of air for separation. The turbine, may if desired, exhaust into the lower pressure rectification column.

Typically, the nitrogen and oxygen products of the air separation are required or produced at a little in excess of atmospheric pressure. Thus, the operating pressure at the top of the lower pressure column is conventionally a selected pressure in the range of 1 to 1.5 bar. This pressure in turn governs the pressure in the higher pressure column since the two columns are linked by the condenser-reboiler. There is sometimes, however, a need to provide an oxygen product at a pressure well above atmospheric pressure. In such circumstances it can be advantageous to operate the lower pressure column at a pressure above 2 bar. On the same or other occasions, air is available at a pressure typically in the range of 10 to 20 bar as a bleed from the air compressor of the gas turbine. It is convenient and advantageous on these occasions to operate the higher pressure column at substantially the pressure produced by this air compressor, and such a higher pressure column operating pressure entails a lower pressure column operating pressure well above 1.5 bar. Indeed, US-A-4 224 045 discloses that the optimum power consumption for the air separation process is when the higher pressure rectification is in the order of 10 bar and that the power consumption is favourable even at considerably higher pressures.

The favourable economics of operating an air separation plant such that the oxygen and nitrogen products are produced at a pressure in excess of 2 bar from the lower pressure column are dependent upon there being a use for both products at this production pressure or one higher. In general, there is a growing demand for large, continuous flows of high pressure oxygen in such processes as coal gasification, partial oxidation and the manufacture of iron by direct reduction. There is rarely however a complementary demand for high pressure nitrogen on the site where the oxygen is used. Nonetheless, if the source of the air for separation is a bleed from the air compressor of a gas turbine, these are typically opportunities for recovering power from the pressurised nitrogen product by expanding it in the expander of the gas turbine. Such use of nitrogen helps to increase the overall power output, to compensate for the air bled from the air compressor of the gas turbine, and, if the nitrogen is introduced into the combustion chamber of the gas turbine to reduce the formation of oxides of nitrogen in the combustion products. Such use of nitrogen, is for example, disclosed in US-A-4 224 045, US-A-4 557 735, US-A-4 806 136 and EP-A-0 384 688.

It is not always however economically feasible to operate a gas turbine on the site where the elevated pressure oxygen product is produced. In addition, it is not always technically desirable to introduce large quantities of nitrogen into the combustion chamber or expander of a gas turbine. Further, even when there is a demand for nitrogen for expansion in the expander of a gas turbine, this demand may fall substantially short of the production of nitrogen in the air separation plant. Accordingly, there is a need for ah air separation method and apparatus which is able to produce oxygen at an elevated pressure but which is at the same time able to minimise the rate of production, if any, of gaseous nitrogen product at elevated pressure. It is an aim of the present invention to provide a method and apparatus that meet this need.

SUMMARY OF THE INVENTION

According to the present invention there is provided a method of separating air comprising the steps of:

a) reducing by heat exchange the temperature of compressed feed air stream to a level suitable for its separation by rectification;

b) separating the air stream by rectification in a double rectification column comprising a higher pressure column and a lower pressure column, wherein the pressure at the top of the lower pressure column is at least 2 bar and preferably in the range of from 2 to 8 bar;

c) withdrawing a stream of gaseous oxygen product from the lower pressure column and warming it by heat exchange countercurrently to the feed air stream;

d) withdrawing a product stream of nitrogen from the lower pressure column and warming it by heat exchange countercurrently to the feed air stream;

e) withdrawing at different temperatures from one another first and second side streams of nitrogen from the product nitrogen stream being heat exchanged countercurrently to the feed air, expanding the first and second side streams in, respectively, first and second expansion turbines, and warming the resultant expanded side streams by heat exchange countercurrently to the feed air stream;

f) compressing at least part of the warmed product stream of nitrogen; and g) cooling the compressed product stream of nitrogen by heat exchange countercurrently to the oxygen product stream and then condensing the cooled product stream of nitrogen to form a liquid nitrogen product.

The invention also provides apparatus for separating air comprising:

a) a main heat exchanger for reducing by heat exchange the temperature of a compressed air feed stream to a level suitable for its separation by rectification;

b) a double rectification column for separating the air stream comprising a higher pressure column and a lower pressure column.

c) passages through the main heat exchanger communicating with an outlet from the lower pressure rectification column for a gaseous oxygen product to enable a stream of the oxygen product to flow through the main heat exchanger countercurrently to the feed air stream;

d) passages through the main heat exchanger communicating with an outlet from the lower pressure rectification column for gaseous nitrogen to enable a product stream of the gaseous nitrogen to flow through the main heat exchanger countercurrently to the feed air stream and thereby be warmed;

e) first and second expansion turbines for withdrawing respectively first and second side streams from the product stream of gaseous nitrogen at different regions of the main heat exchanger; for expanding the side streams, and for returning the side streams to further passages through the main heat exchanger for flow therethrough countercurrently to the feed air stream;

f) a compressor for compressing at least part of the warmed product nitrogen stream;

g) yet further passages through the main heat exchanger for the flow of the compressed product nitrogen stream countercurrently to the product oxygen stream so as to cool the compressed product nitrogen stream;

h) a condenser for condensing the cooled product nitrogen stream thereby to form liquid nitrogen product.

The method and apparatus according to the present invention make it possible for most if not all of the gaseous nitrogen that is produced to be at substantially ambient pressure, thereby keeping down the loss of work of compression if no use can be found for this nitrogen. This advantage is able to be achieved by virtue of the expansion of the side streams in the turbines. The method and apparatus according to the invention are able to produce liquid nitrogen product at more than 30% of the rate at which gaseous oxygen is produced without there being an extravagant requirement for compression of the nitrogen. Thus, the nitrogen compressor typically operates at a lower pressure than that at which the feed air stream enters the main heat exchanger.

The method and apparatus according to the invention are particularly suitable for use when the source of the feed air stream is a bleed from the air compressor of a gas turbine and when there is at most only a small requirement for nitrogen to be returned to the combustion chamber or expander of the gas turbine, for example when the source of fuel gas for the combustion chamber is a blast furnace operated with coal injection and with oxygen-enrichment of its air blast.

The feed air stream is desirably purified by removal therefrom of water vapour and carbon dioxide. The purification may be accomplished by any method known in the art.

The double rectification column and its operation are preferably generally as described hereinabove.

If desired, a minor part of the cooled air feed stream may be taken therefrom and condensed and the resulting condensed liquid air introduced into the higher pressure column at a level above that at which the rest of the air feed stream is introduced.

If desired a small amount of liquid oxygen product may be produced in addition to the gaseous oxygen and liquid nitrogen product.

The higher pressure rectification column preferably operates at a pressure in the range of 10 to 20 bar and the lower pressure rectification column most preferably operates at a pressure in the range of 3 to 8 bar. If the source of the feed air stream is the air compressor of a gas turbine the pressure at the bottom of the higher pressure column is preferably not more than 1.0 bar below the outlet pressure of the air compressor.

The first side stream is preferably withdrawn from the product nitrogen stream at a temperature in the range 140 to 180 K and preferably leaves the first expansion turbine at a temperature lower than that at which the feed air stream enters the double rectification column. The second side stream is preferably withdrawn from the product nitrogen stream at a temperature in the range of 180 to 250 K and preferably leaves the second expansion turbine at approximately the same temperature as the inlet temperature of the first expansion turbine.

Although most of the nitrogen in the product nitrogen stream is withdrawn therefrom in the first and second side streams there is still an appreciable capacity for the production of liquid nitrogen.

The nitrogen compressor preferably has an outlet pressure intermediate the pressure at the bottom of the higher pressure column and the pressure at the top of the lower pressure column.

The cooled product nitrogen stream is preferably condensed by a stream of oxygen-enriched liquid air withdrawn from the higher pressure column. The liquid air stream is typically vaporised by heat exchange with the product nitrogen stream and the resulting vaporised air is preferably introduced into the lower pressure column. The condensed liquid nitrogen is preferably sub-cooled and passed to storage.

BRIEF DESCRIPTION OF THE DRAWING

A method and apparatus according to the invention will now be described by way of example with reference to the accompanying drawing which is a schematic flow diagram of an air separation plant.

DETAILED DESCRIPTION

Referring to the drawing, air is bled typically at a rate of from 20 to 35% from the outlet of an air compressor 4 forming part of a gas turbine additionally including a combustion chamber 6 and an expander 8. The combustion chamber is adapted to burn a low grade fuel gas having a calorific value of less than 5MJ/m$^3$ such as blast furnace off-gas. The resulting combustion products are expanded in the expander 8. The gas turbine is typically used to drive an alternator 10 and is thus able to generate electricity.

The air bleed from the air compressor 4 is cooled from a temperature of about 400° C. to approximately ambient temperature in a heat exchanger 12 by heat exchange with a suitable heat exchange medium, for example water under a pressure of from 20 to 25 bar. The resulting hot pressurised water may be used to moisturise the fuel gas that is burned in the combustion chamber 6 of the gas turbine 2.

The resulting cooled feed air stream typically at a pressure of about 15 bar is passed through a purification apparatus 14 effective to remove water vapour and carbon dioxide from the compressed air. The apparatus 14 employs beds of adsorbent (not shown) to effect this removal of water vapour and carbon dioxide. The beds are operated out of sequence with one another such that while one or more beds are being used to purify air the remainder are being regenerated for example by means of a stream of hot nitrogen.

The purified feed air stream then flows through a main heat exchanger 15 from its warm end 18 to its cold end 20. It is reduced in temperature by its passage through the main heat exchanger 16 to a level suitable for its separation by rectification. Typically, therefore, the feed air stream is cooled to its saturation temperature at the pressure at which its leaves the cold end 20 of the heat exchanger 15. The feed air stream is then divided into major and minor subsidiary streams. The major subsidiary air stream is introduced into the bottom region of a higher pressure rectification column 24 through an inlet 28. The higher rectification column 24 is one column of a double rectification column 22. The other column of the double rectification column 22 is a lower pressure rectification column 26. Both the higher pressure and the lower pressure rectification columns 24 and 26 contain liquid vapour contact trays 30 and associated downcomers (not shown) whereby a descending liquid phase is brought into intimate contact with an ascending vapour phase such that mass transfer occurs between the two phases. The descending liquid phase becomes progressively richer in oxygen and the ascending vapour phase progressively richer in nitrogen.

The inlet 28 for the major subsidiary stream of air is located beneath the liquid-vapour contact trays 30 in the column 24. The air introduced into the column 24 through the inlet 28 forms the vapour that ascends the column 24. The descending liquid is provided by a condenser-reboiler 32 which is shared by the lower pressure column 26 and the higher pressure column 24. Nitrogen vapour flows into the condensing passages of the condenser-reboiler 32 from the top of the higher pressure column 24 and is condensed therein by heat exchange with oxygen from the bottom of the lower pressure column 26, the oxygen being reboiled as a result of the heat exchange to create an ascending flow of vapour in the lower pressure column 26. Part of the condensed nitrogen forms a descending liquid flow in the higher pressure column 24. The remainder of the condensed nitrogen is collected, is withdrawn from the higher pressure column 24, is sub-cooled by passage through a heat exchanger 34 and is introduced through an expansion or throttling valve 36 into the lower pressure column 26 and thereby provides reflux for the column 26.

The minor subsidiary air stream is condensed by passage through a heat exchanger 38 and is then introduced into the higher pressure column 24 at a level a few trays above that of the lowest tray therein. Oxygen enriched liquid air is taken from the bottom of the column 26 and is sub-cooled by passage through a heat exchanger 40. The resulting sub-cooled oxygen-enriched liquid air stream is divided into two parts downstream of the heat exchanger 40. One part is passed through an expansion or throttling valve 42 into the lower pressure column 26 at an intermediate level thereof. The other part of the sub-cooled liquid air stream is passed through a throttling or expansion valve 44 into a second condenser-reboiler 46 and is boiled therein. The resulting vaporised air is introduced into the low pressure column 26 through an inlet 37 at an intermediate level thereof below that at which the first part of the sub-cooled liquid air stream is introduced. The air introduced at these two levels is separated in the column 26 into nitrogen and oxygen, the latter product typically containing in the order of 5% by volume in total of nitrogen and argon.

A stream of gaseous oxygen product flows out of the bottom of the lower pressure rectification column 26 through an outlet 39 and passes through the heat exchanger 38 countercurrently to the minor stream of air. Downstream of the heat exchanger 38, the gaseous oxygen product stream enters the main heat exchanger 16 at its cold end 20 and flows therethrough countercurrently to the feed air stream, thus being warmed by heat exchange to approximately ambient temperature. The product oxygen stream flows out of the warm end 18 of the main heat exchanger 16 and may then be supplied to the plant in which it is to be used.

A product nitrogen vapour stream flows out of the top of the lower pressure rectification column 26 through an outlet 41 and passes through first the heat exchanger 34, thereby providing cooling for it, secondly through the heat exchanger 40 providing cooling for it, and then through the main heat exchanger 16 from its cold end 20 to its warm end 18. A first side stream of nitrogen is withdrawn from the product nitrogen stream at a first intermediate region of the main heat exchanger 16. The first side stream enters the inlet of a first expansion turbine 48 at a temperature of about 156 K and is expanded therein to a pressure a little above 1 bar. The expanded first side stream leaves the turbine 48 at a temperature of about 112 K and is returned through the main heat exchanger 15 from its cold end 20 to its warm end 18. The resulting low pressure nitrogen leaves the warm end 18 of the heat exchanger 16 at approximately ambient temperature and may if desired be discharged to the atmosphere or supplied to another process in which it may be used. A second side stream of nitrogen is withdrawn from the product nitrogen stream at a second intermediate region of the main heat exchanger 16 which is at a higher temperature than the first intermediate region. The second side stream enters the inlet of a second expansion turbine 50 at a temperature of about 214 K and is expanded therein to a pressure a little above 1 bar. The expanded second side stream leaves the second expansion turbine 50 at a temperature of about 156 K and is united with the first side stream at a region of the main heat exchanger 16 where the temperature of the first side stream is about 156 K.

The product nitrogen stream leaves the warm end 18 of the main heat exchanger 16 at about ambient temperature. Preferably all of the product nitrogen then flows into a compressor 52 provided with an aftercooler (not shown) to remove heat of compression. The product nitrogen is compressed in the compressor 52 to a pressure of about 9 bar. The compressed product nitrogen stream then flows through the main heat exchanger 16 from its warm end 18 to its cold end 20. From the cold end 20 of the main heat exchanger 16 the product nitrogen stream passes into the condenser-reboiler 46 and is condensed therein. The resulting liquid nitrogen stream is sub-cooled first by passage through the heat exchanger 34 and then by passage through a heat exchanger 54. The resulting sub-cooled liquid nitrogen flashes through an expansion or throttling valve 56 into a storage vessel 58 having an outlet 60 for the withdrawal of product liquid nitrogen. The outlet 60 has a stop valve 62 located therein. The valve 62 may be open when it is required to withdrawn liquid nitrogen product. Flash gas flows out of the storage vessel 58 through an outlet 64 and passes through the heat exchanger 54 countercurrently to the product liquid nitrogen stream, thereby providing cooling for the heat exchanger 54. From the heat exchanger 54 the gaseous nitrogen stream flows through the heat exchanger 38 and is then united with the first side stream of nitrogen at a region intermediate the outlet of the first turbine 48 and the cold end 20 of the main heat exchanger 16.

If desired, although not shown in the drawing, some liquid oxygen product may be withdrawn from the bottom of the lower pressure rectification column 26 through an outlet 66, sub-cooled in the heat exchanger 34 and then transferred to storage.

The main heat exchanger 16 is preferably of the plate-fin kind and is therefore readily able to be fabricated with appropriate headers and sets of passages for each of the streams that pass therethrough.

The expansion or throttling valves may each simply comprise a tubular member having an outlet of greater internal diameter than its inlet.

In an example of the operation of a plant of the kind shown in the drawings, but with additional means for producing liquid oxygen, as described above, a stream of purified air leaves the apparatus 15 at a rate of 299251 $sm^3/hr$, a pressure of 14.6 atmospheres absolute and a temperature of 300.7 K. The composition of the purified air stream is 21.0% by volume of oxygen; 78.1% by volume of nitrogen and 0.9% by volume of argon. Five different product streams are produced as shown in Table 1 below.

TABLE 1

| Product | Flow/$Sm^3$ $hr^{-1}$ | P/atm(a) | T/K | Composition/% by vol O2 | N2 | Ar |
|---|---|---|---|---|---|---|
| Oxygen gas | 63607.9 | 296.7 | 4.87 | 95.0 | 3.0 | 2.0 |
| Liquid oxygen | 1300.3 | 95.85 | 4.9 | 95.0 | 3.0 | 2.0 |
| Liquid nitrogen | 20354.5 | 79.9 | 1.3 | — | 99.94 | 0.05 |
| Low pressure nitrogen gas | 212371.7 | 296.7 | 1.2 | 0.5 | 99.1 | 0.4 |
| High pressure nitrogen gas | 1161.8 | 296.7 | 4.7 | 0.5 | 99.1 | 0.4 |

TABLE 1-continued

| Product | Flow/$Sm^3$ $hr^{-1}$ | T/K | P/atm(a) | Composition/% by vol O2 | N2 | Ar |
|---|---|---|---|---|---|---|

What is claimed is:

1. A method of separating air comprising the steps of:
   a) reducing by heat exchange the temperature of a compressed air feed stream to a level suitable for its separation by rectification;
   b) separating the air stream by rectification in a double rectification column comprising a higher pressure column and a lower pressure column, wherein the pressure at the top of the lower pressure columm is at least 2 bar;
   c) withdrawing a stream of gaseous oxygen product from the lower pressure column and warming it by heat exchange countercurrently to the feed air stream;
   d) withdrawing a product stream of nitrogen from the lower pressure column and warming it by heat exchange countercurrently to the feed air stream;
   e) withdrawing at different temperatures from one another first and second side streams of nitrogen from the product nitrogen stream being heat exchanged countercurrently to the feed air, expanding the first and second side streams in, respectively, first and second expansion turbines, and warming the resultant expanded side streams by heat exchange countercurrently to the feed air stream;
   f) compressing at least part of the warmed product stream of nitrogen; and
   g) cooling the compressed product stream of nitrogen by heat exchange countercurrently to the oxygen product stream and then condensing the cooled product stream of nitrogen to form a liquid nitrogen product.

2. The method as claimed in claim 1, in which the feed air stream is taken from an air compressor forming part of a gas turbine.

3. The method as claimed in claim 2, in which the feed air stream leaves the air compressor at elevated temperature and is cooled by heat exchange with a pressurised stream of water.

4. The method as claimed in claim 1, in which a minor part of the cooled air feed stream is taken therefrom and is condensed upstream of being introduced into the higher pressure column at a level above that at which the remainder of the feed air stream is introduced.

5. The method as claimed in claim 1, in which the first side stream is withdrawn from the product nitrogen stream at a temperature in the range of 140 to 180 K and leaves the first expansion turbine at a temperature lower than that at which the feed air enters the double rectification column.

6. The method as claimed in claim 1, in which the second side stream is withdrawn from the product nitrogen stream at a temperature in the range of 180 to 250 K and leaves the second expansion turbine at a temperature approximately equal to that at which the first side stream enters the first turbine.

7. The method as claimed in claim 1, in which the nitrogen product stream is compressed to a pressure intermediate the pressure at the bottom of the higher pressure column and the pressure at the top of the lower pressure column.

8. The method as claimed in claim 1, in which the cooled product nitrogen stream is preferably condensed by a stream of oxygen-enriched liquid air withdrawn form the higher pressure column.

9. The method as claimed in claim 8, in which the said stream of oxygen-enriched liquid air is vaporised as it condenses the product nitrogen stream, and the resulting vaporised oxygen-enriched air is introduced into the lower pressure column.

10. An apparatus for separating air comprising:

a) a main heat exchanger for reducing by heat exchange the temperature of a compressed air feed stream to a level suitable for its separation by rectification;

b) a double rectification column for separating the air stream comprising a higher pressure column and a lower pressure column;

c) passages through the main heat exchanger communicating with an outlet from the lower pressure rectification column for a gaseous oxygen product to enable a stream of the oxygen product to flow through the main heat exchanger countercurrently to the feed air stream;

d) passages through the main heat exchanger communicating with an outlet from the lower pressure rectification column for gaseous nitrogen to enable a product stream of the gaseous nitrogen to flow through the main heat exchanger countercurrently to the feed air stream and thereby be warmed;

e) first and second expansion turbines for withdrawing at different temperature from one another respectively first and second side streams from the product stream of gaseous nitrogen at different regions of the main heat exchanger; for expanding the side streams, and for returning the side streams to further passages through the main heat exchanger for flow therethrough countercurrently to the feed air stream;

f) a compressor for compressing at least part of the warmed product nitrogen stream;

g) yet further passages through the main heat exchanger for the flow of the compressed product nitrogen stream countercurrently to the product oxygen stream so as to cool the compressed product nitrogen stream; and h) a condenser for condensing the cooled product nitrogen stream thereby to form liquid nitrogen product.

11. The apparatus as claimed in claim 10, wherein the source of the compressed feed air stream is an air compressor forming part of a gas turbine.

12. The apparatus as claimed in claim 10, additionally including a further heat exchanger for cooling the compressed feed air stream upstream of the main heat exchanger.

* * * * *